US010814216B2

(12) United States Patent
Tsai

(10) Patent No.: US 10,814,216 B2
(45) **Date of Patent: *Oct. 27, 2020**

(54) GAME SCORING AND TRACKING SYSTEM

(71) Applicant: Medal Sports (Taiwan) Corporation, Taipei (TW)

(72) Inventor: Kevin Chunhao Tsai, Kaohsiung (TW)

(73) Assignee: Medal Sports (Taiwan) Corporation (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/580,234

(22) Filed: Sep. 24, 2019

(65) Prior Publication Data

US 2020/0016478 A1 Jan. 16, 2020

Related U.S. Application Data

(63) Continuation of application No. 15/916,533, filed on Mar. 9, 2018, now Pat. No. 10,427,031.

(51) Int. Cl.

| | |
|---|---|
| ***A63F 7/06*** | (2006.01) |
| ***A63F 7/07*** | (2006.01) |
| ***A63F 7/00*** | (2006.01) |

(52) U.S. Cl.

CPC ..... *A63F 7/0005* (2013.01); *A63F 7/0017* (2013.01); *A63F 7/0636* (2013.01); *A63F 7/0668* (2013.01)

(58) Field of Classification Search

None

See application file for complete search history.

(56) References Cited

U.S. PATENT DOCUMENTS

| | | | | |
|---|---|---|---|---|
| 6,276,682 | B1 | 8/2001 | Yamashita et al. | |
| 6,623,004 | B2 | 9/2003 | Rossi et al. | |
| 7,219,891 | B2 | 5/2007 | Giegerich et al. | |
| 7,789,390 | B2 | 9/2010 | Giegerich et al. | |
| 7,900,921 | B1 | 3/2011 | Palmer et al. | |
| 8,025,293 | B1 | 9/2011 | Crawford et al. | |
| 8,684,357 | B2 | 4/2014 | Brooks et al. | |
| 10,427,031 | B1 * | 10/2019 | Tsai | A63F 7/307 |
| 2003/0168801 | A1 | 9/2003 | Zucchi et al. | |

(Continued)

OTHER PUBLICATIONS

Office Action for U.S. Appl. No. 15/916,533 dated Apr. 2, 2019.

*Primary Examiner* — Raleigh W Chiu

(74) *Attorney, Agent, or Firm* — John R. Kasha; Kelly L. Kasha; Kasha Law LLC

(57) ABSTRACT

The present disclosure provides a game scoring and tracking system, including a playing surface, a projectile, a central unit, at least one speaker, a first corner illuminated indicia, a second corner illuminated indicia, a third corner illuminated indicia, a fourth corner illuminated indicia, a first goal, and a second goal. The first goal and the second goal are configured to receive the projectile from the playing surface. The first goal and the second goal each include an at least one sensor communicatively coupled to the central unit. The at least one sensor detects the projectile entering the applicable goal. The at least one speaker outputs various sounds and the first corner illuminated indicia, the second corner illuminated indicia, the third corner illuminated indicia, and the fourth corner illuminated indicia illuminate in numerous sequences to indicate the status of a game event.

20 Claims, 12 Drawing Sheets

(56) References Cited

U.S. PATENT DOCUMENTS

| | | | |
|---|---|---|---|
| 2004/0036210 | A1 | 2/2004 | Oister et al. |
| 2004/0164488 | A1 | 8/2004 | Fitzgerald |
| 2005/0012267 | A1 | 1/2005 | Tien |
| 2005/0127601 | A1 | 6/2005 | Giegerich et al. |
| 2007/0164510 | A1 | 7/2007 | Chen |
| 2009/0302533 | A1 | 12/2009 | Smith |
| 2011/0233861 | A1 | 9/2011 | Brooks et al. |
| 2013/0221614 | A1 | 8/2013 | Toshima et al. |

* cited by examiner

GAME SCORING AND TRACKING SYSTEM

RELATED APPLICATION

This Application is a Continuation of application Ser. No. 15/916,533 filed on Mar. 9, 2018. The entire contents of these applications are incorporated herein by reference in their entirety.

TECHNICAL FIELD

This disclosure relates to a game scoring and tracking system for a table game.

BACKGROUND

Manufacturers of table games, such as air hockey, foosball, and table hockey, are constantly looking for ways to improve the game playing experience for its players. Commonly, the scoring and tracking systems incorporated in these games consist of a basic LED electronic overhead or side mounted display. Typically, these displays serve a functional purpose only, displaying the current score of each of the game's players. These simple displays do not add excitement or enjoyment to the game playing experience.

While scoring and tracking systems incorporating these simplistic displays have proven useful for their intended purposes, a need for continuous improvement in the pertinent art remains.

SUMMARY

One aspect of the disclosure provides a game scoring and tracking system. The game scoring and tracking system includes: a playing surface, a projectile, a central unit, an at least one speaker, a first end wall, a second end wall, a first side wall, a second side wall, a first corner illuminable indicia, a second corner illuminable indicia, a third corner illuminable indicia, a fourth corner illuminable indicia, a first goal, and a second goal. The projectile is configured for use on the playing surface. The central unit is located below the playing surface. The at least one speaker is communicatively coupled to the central unit. The first end wall extends generally perpendicular from the playing surface. The second end wall is spaced apart from the first end wall. The first side wall extends between the first end wall and the second end wall. The second side wall is spaced apart from the first side wall. The second side wall extends between the first end wall and the second end wall. The first corner illuminable indicia is configured to connect the first end wall to the first side wall. The first corner illuminable indicia is communicatively coupled to the central unit. The second corner illuminable indicia is configured to connect the second end wall to the first side wall. The second corner illuminable indicia is communicatively coupled to the central unit. The third corner illuminable indicia is configured to connect the second end wall to the second side wall. The third corner illuminable indicia is communicatively coupled to the central unit. The fourth corner illuminable indicia is configured to connect the first end wall to the second side wall. The fourth corner illuminable indicia is communicatively coupled to the central unit. The first goal is located along the first end wall between the first corner illuminable indicia and the fourth corner illuminable indicia. The first goal is configured to receive the projectile from the playing surface. The first goal includes a first at least one sensor communicatively coupled to the central unit. The second goal is located along the second end wall between the second corner illuminable indicia and the third corner illuminable indicia. The second goal is configured to receive the projectile from the playing surface. The second goal includes a second at least one sensor communicatively coupled to the central unit. The first at least one sensor detects the projectile entering the first goal. The second at least one sensor detects the projectile entering the second goal.

In some implementations, the first corner illuminable indicia, the second corner illuminable indicia, the third corner illuminable indicia, and the fourth corner illuminable indicia are configured to illuminate in a first sequence and the at least one speaker is configured to output a first sound, defining a power-up mode, upon the occurrence of a start of a new game.

In some examples, the first corner illuminable indicia and the fourth corner illuminable indicia are configured to illuminate in a second sequence and the at least one speaker is configured to output a second sound, defining a first scoring mode, upon the occurrence of the first at least one sensor detecting the projectile entering the first goal.

In some configurations, the second corner illuminable indicia and the third corner illuminable indicia are configured to illuminate in a third sequence and the at least one speaker in configured to output a third sound, defining a second scoring mode, upon the occurrence of the second at least one sensor detecting the projectile entering the second goal.

In some examples, the first corner illuminable indicia and the fourth corner illuminable indicia are configured to display a first score, wherein the first score is representative of the number of times the projectile is detected by the first at least one sensor entering the first goal. In these configurations, the second corner illuminable indicia and the third corner illuminable indicia are configured to display a second score, wherein the second score is representative of the number of times the projectile is detected by the second at least one sensor entering the second goal.

In some examples, the first corner illuminable indicia, the second corner illuminable indicia, the third corner illuminable indicia, and the fourth corner illuminable indicia are configured to illuminate in a fourth sequence and the at least one speaker is configured to output a fourth sound, defining a rah-rah mode, upon the occurrence of the projectile not being detected by the first at least one sensor entering the first goal and the projectile not detected by the second at least one sensor entering the second goal for a predetermined time.

In some configurations, the first corner illuminable indicia and the fourth corner illuminable indicia are configured to illuminate in a fifth sequence and the at least one speaker is configured to output a fifth sound, defining a first end of game mode, to indicate a game winner upon the first score reaching a predetermined threshold. In these configurations, the second corner illuminable indicia and the third corner illuminable indicia are configured to illuminate in a sixth sequence and the at least one speaker is configured to output a sixth sound, defining a second end of game mode, to indicate a game winner upon the second score reaching a predetermined threshold.

One aspect of the disclosure provides a method of indicating a status of a game event. The method includes: detecting a projectile entering a first goal by a first at least one sensor, and detecting the projectile entering a second goal by a second at least one sensor. Illuminating a first corner illuminable indicia and a second corner illuminable indicia in a first sequence and outputting an at least one speaker a first sound, defining a first scoring mode, upon the first at least one sensor detecting the projectile entering the first goal. Illuminating a third corner illuminable indicia and a fourth corner illuminable indicia in a second sequence and outputting the at least one speaker a second sound, defining a second scoring mode, upon the second at least one sensor detecting the projectile entering the second goal. Displaying via the first corner illuminable indicia and the second corner illuminable indicia a first score, wherein the first score is representative of the number of times the projectile is detected by the first at least one sensor entering the first goal. Displaying via the third corner illuminable indicia and the fourth corner illuminable indicia a second score, wherein the second score is representative of the number of times the projectile is detected by the second at least one sensor entering the second goal. Indicating a game winner by illuminating the first corner illuminable indicia and the second corner illuminable indicia in a third sequence and outputting the at least one speaker a third sound, defining a first end of game mode, upon the first score reaching a predetermined threshold. Indicating a game winner by illuminating the third corner illuminable indicia and the fourth corner illuminable indicia in a fourth sequence and outputting the at least one speaker a fourth sound, defining a second end of game mode, upon the second score reaching a predetermined threshold.

In some examples, the method further includes illuminating the first corner illuminable indicia, the second corner illuminable indicia, the third corner illuminable indicia, and the fourth corner illuminable indicia in a fifth sequence and outputting the at least one speaker a fifth sound, defining a power-up mode, upon the occurrence of a start of a new game.

In some examples, the method further includes illuminating the first corner illuminable indicia, the second corner illuminable indicia, the third corner illuminable indicia, and the fourth corner illuminable indicia in a sixth sequence and outputting the at least one speaker a sixth sound, defining a rah-rah mode, upon the projectile not being detected by the first at least one sensor entering the first goal nor by the second at least one sensor entering the second goal for a predetermined time.

Another aspect of the disclosure provides a game scoring and tracking system. The game scoring and tracking system includes: a playing surface, a central unit, a projectile configured for use on top of the playing surface, a first goal configured to receive the projectile, a second goal configured to receive the projectile, a first score defining the number of times the projectile is detected by the first at least one sensor entering the first goal, and a second score defining the number of times the projectile is detected by the second at least one sensor entering the second goal. The first goal includes a first at least one sensor configured to detect the projectile entering the first goal. The second goal includes a second at least one sensor configured to detect the projectile entering the second goal. The improvements of the game scoring and tracking system include: a first corner illuminable indicia communicatively coupled to the central unit, a second corner illuminable indicia communicatively coupled to the central unit, a third corner illuminable indicia communicatively coupled to the central unit, a fourth corner illuminable indicia communicatively coupled to the central unit, an at least one speaker communicatively coupled to the central unit, a means for indicating a goal has been scored upon the occurrence of either the first at least one sensor detecting the projectile entering the first goal or the second at least one sensor detecting the projectile entering the second goal defining a scoring mode, and a means for indicating a game winner upon the occurrence of either the first score reaching a predetermined threshold or the second score reaching a predetermined threshold defining an end of game mode.

In some configurations, the system further includes a control having a reset button and an on/off button, and a means for indicating a start of a new game upon either the reset button or the on/off button being pressed defining a power-up mode.

In some configurations, the system further includes a means for indicating the projectile has not been detected by the first at least one sensor entering the first goal nor by the second at least one sensor entering the second goal for a predetermined time defining a rah-rah mode.

In some examples, the first corner illuminable indicia and the second corner illuminable indicia are configured to display the number of times the projectile is detected by the first at least one sensor entering the first goal.

In some examples, the second corner illuminable indicia and the third corner illuminable indicia are configured to display the number of times the projectile is detected by the second at least one sensor entering the second goal.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
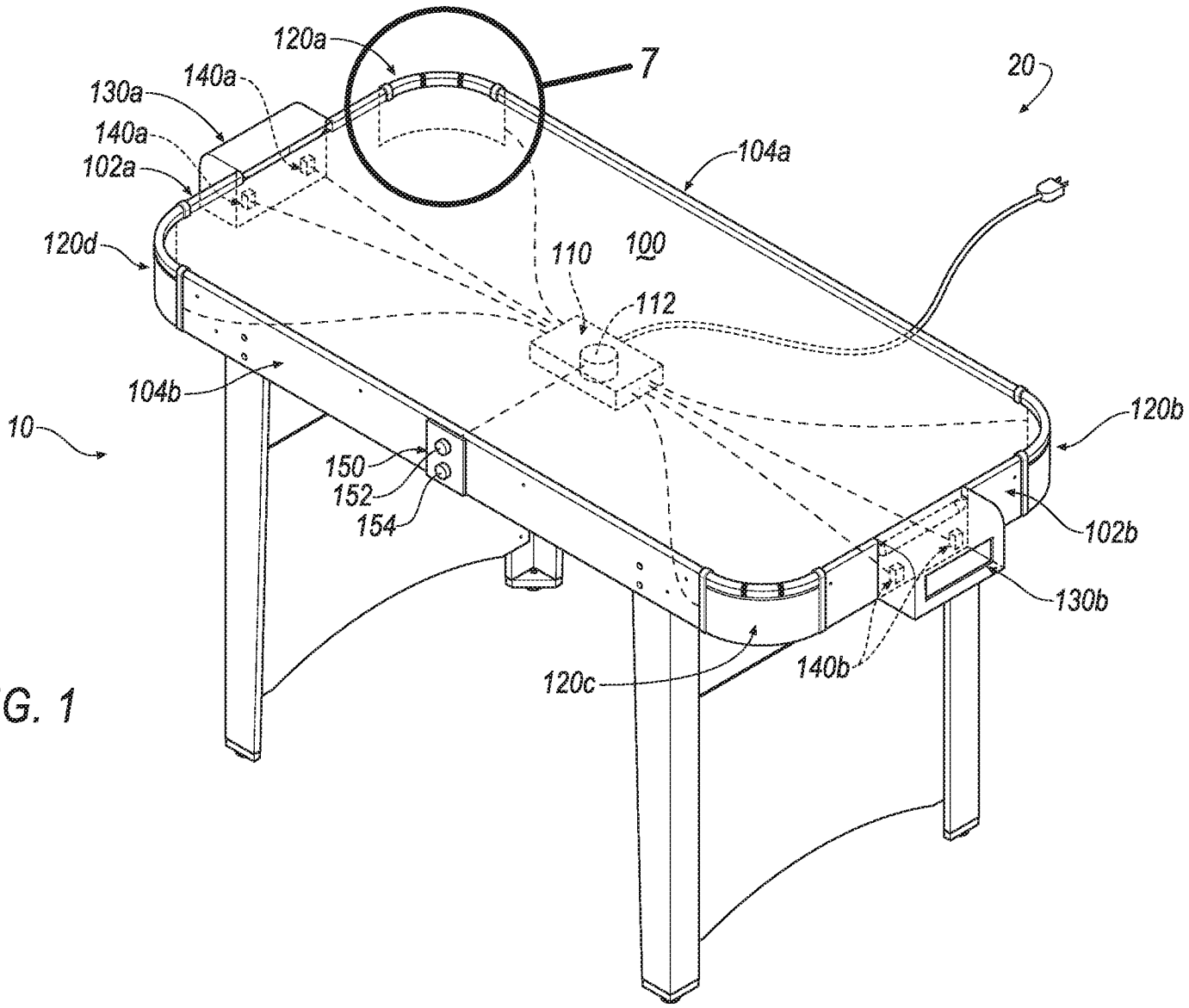
FIG. 1 is an isometric view of a table game incorporating an example game scoring and tracking system. The example game scoring and tracking system including four example corner illuminable indicia.

FIG. 1 is an example of a game scoring and tracking system 20 incorporated into a table game 10. The example game scoring and tracking system 20 may be implemented in table games, such as air hockey, foosball, table hockey, or other versions of entertainment games that may be confined to a table. Typically, the table game 10 includes a playing surface 100, a first goal 130*a*, and a second goal 130*b*. The playing surface 100 is generally an area for playing the table game. Usually, the table game is played with a projectile 160, which is configured to be used on top of the playing surface 100. A projectile 160 may be a ball or a puck.

In some examples, the playing surface 100 is surrounded by a first end wall 102*a*, a second end wall 102*b*, a first side wall 104*a*, and a second side wall 104*b*. Often, the first end wall 102*a* is generally perpendicular from the playing surface 100. The second end wall 102*b* is spaced apart from the first end wall 102*a*, and is preferably located at the opposite side of the play surface 100 from the first end wall 102*a*. The first side wall 104*a* extends between the first end wall 102*a* and the second end wall 102*b*. The second side wall 104*b* is spaced apart from the first side wall 104*a*, and is preferably located at the opposite side of the play surface 100 from the first side wall 104*a*. The second side wall 104*b* extends between the first end wall 102*a* and the second end wall 102*b*.

In some implementations, the game scoring and tracking system 20 includes a central unit 110 located below the playing surface 100. The central unit 110 may be located at other locations throughout the table game 10. The central unit 110 may include a microcomputer that comprises software to control various features and components of the game scoring and tracking system 20. The central unit 110 may house at least one speaker 112. The at least one speaker 112 outputs numerous sounds to indicate a status of a game event. The sounds may include music, audible noise, game sound effects, etc. In some instances, the at least one speaker 112 may be installed at other locations throughout the table game 10. The at least one speaker 112 is communicatively coupled to the central unit 110. In some examples, the central unit 110 is connected to AC or DC power, which in turn, provide power to the various components of the game scoring and tracking system 20.

In some implementations, the game scoring and tracking system 20 includes a first corner illuminable indicia 120*a*, a second corner illuminable indicia 120*b*, a third corner illuminable indicia 120*c*, and a fourth corner illuminable indicia 120*d*. In some examples, the first corner illuminable indicia 120*a* is configured to connect the first end wall 102*a* to the first side wall 104*a*. The first corner illuminable indicia 120*a* is communicatively coupled to the central unit 110. The second corner illuminable indicia 102*b* is configured to connect the second end wall 102*b* to the first side wall 104*a*. The second corner illuminable indicia 120*b* is communicatively coupled to the central unit 110. The third corner illuminable indicia 120*c* is configured to connect the second end wall 102*b* to the second side wall 104*b*. The third corner illuminable indicia 120*c* is communicatively coupled to the central unit 110. The fourth corner illuminable indicia 120*d* is configured to connect the first end wall 102*a* to the second side wall 104*b*. The fourth corner illuminable indicia 120*d* is communicatively coupled to the central unit 110.

In some examples, the first goal 130*a* is located along the first end wall 102*a*, positioned between the first corner illuminable indicia 120*a* and the fourth corner illuminable indicia 120*d*. The first goal 130*a* is configured to receive the projectile 160 from the playing surface 100. The first goal 130*a* includes a first at least one sensor 140*a*. The first at least one sensor 140*a* detects the projectile 160 entering the first goal 130*a*. In these examples, the second goal 130*b* is located along the second end wall 102*b*, positioned between the second corner illuminable indicia 120*b* and the third corner illuminable indicia 120*c*. The second goal 130*b* is configured to receive the projectile 160 from the playing surface 100. The second goal 130*b* includes a second at least one sensor 140*b*. The second at least one sensor 140*b* detects the projectile 160 entering the second goal 130*b*. The first at least one sensor 140*a* and the second at least one sensor 140*b* may be an infrared sensor or a trigger switch sensor, and one or more sensors may be implemented per goal. For example, two infrared sensors could be installed in each of the first goal and the second goal in order to detect the projectile 160.

In some instances, a control 150 is communicatively coupled to the central unit 110, and the control 150 may be installed on either the first end wall 102*a*, the second end wall 102*b*, the first side wall 104*a*, or the second side wall 104*b*. The control 150 may include an on/off button 154 and a reset button 152. The on/off button 154 powers on or off the game scoring and tracking system 20 when pressed. The reset button 152 resets the game scoring and tracking system 20 when pressed.

Referring to FIGS. 2-6, an example corner illuminable indicia 120 is shown. The corner illuminable indicia 120 may be one of the four corner illuminable indicia 120*a*-*d* shown in FIG. 1. In some examples, the illuminable indicia 120*a*-*d* and the at least one speaker 112 function in sequence with another to indicate the status of different game event. The corner illuminable indicia 120*a*-*d* and the at least one speaker 112 operate in various modes. The modes may include: a power-up mode to signify a start of a new game, a first scoring mode to indicate a first player has scored a goal, a second scoring mode to indicate a second player has scored a goal, a rah-rah mode to signal a period where no goals have been scored by either player for a predetermined time, or an end of game mode to indicate a player has won the game.

Figure 2:
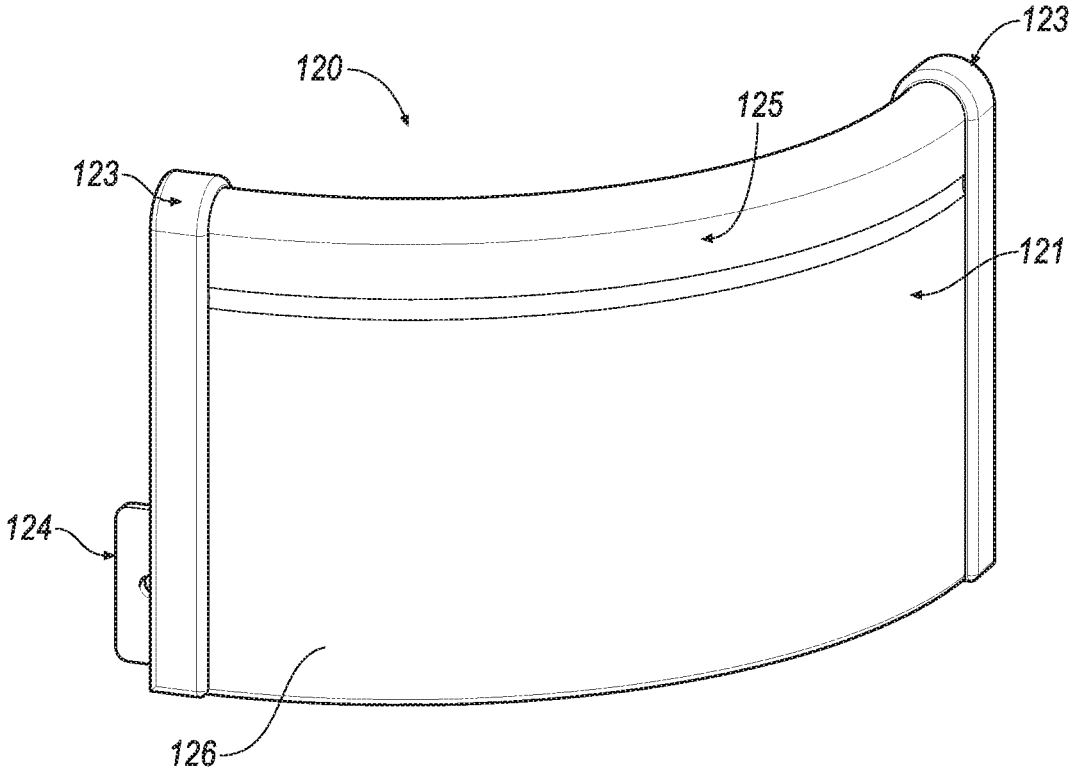
FIG. 2 is an isometric view of an example corner illuminable indicia.
Figure 3:
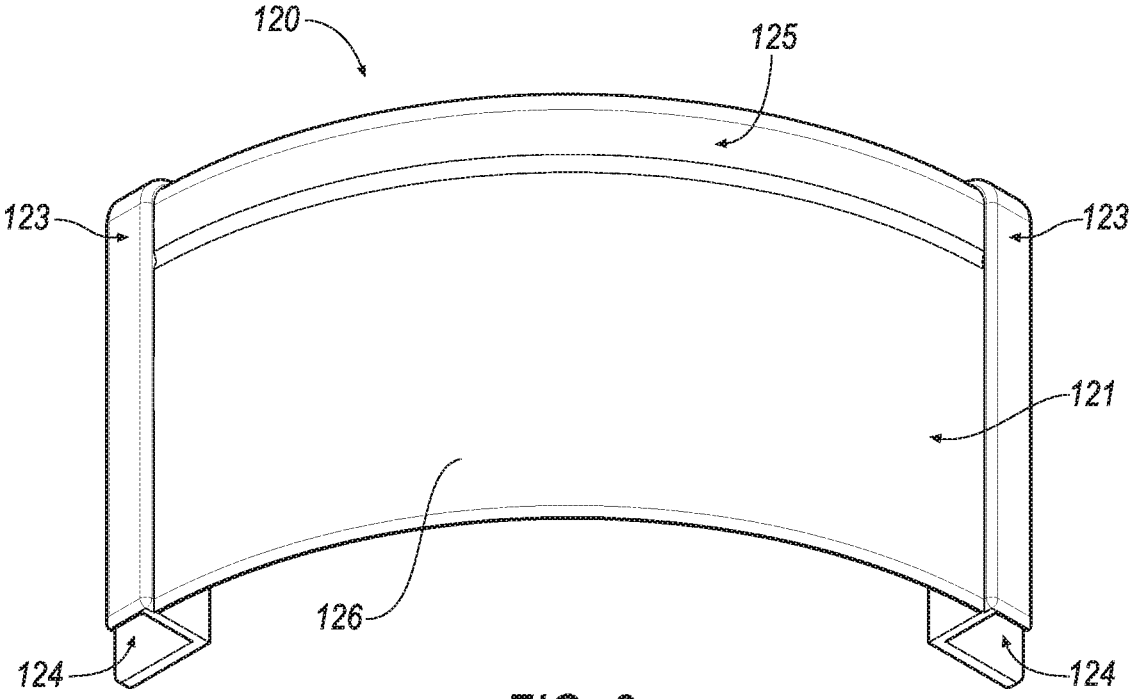
FIG. 3 is another isometric view of an example corner illuminable indicia.
Figure 4:
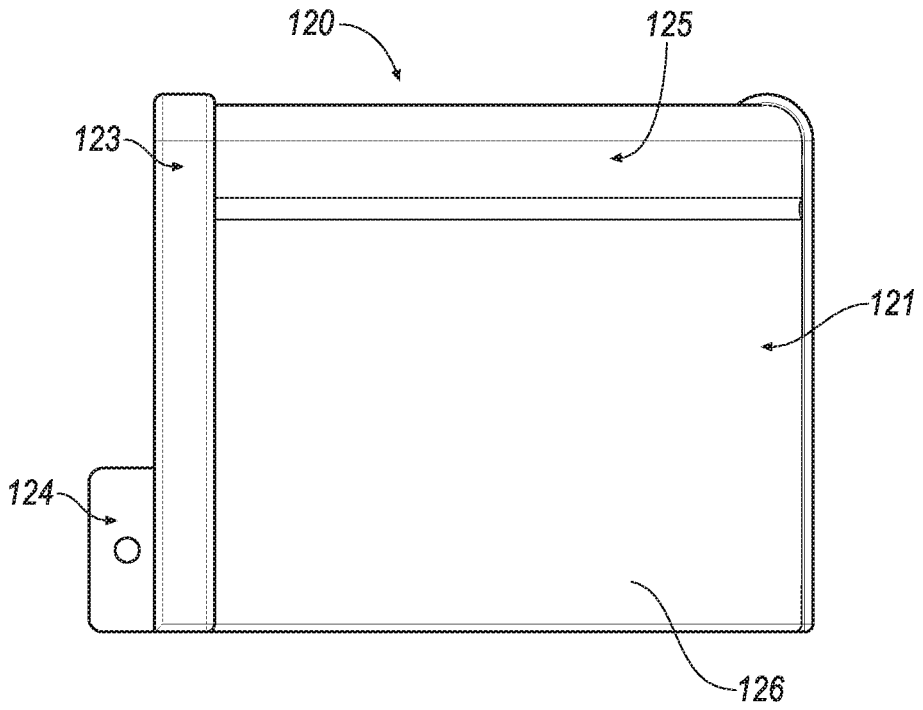
FIG. 4 is a plan view of an example corner illuminable indicia.

Referring to FIGS. 2, 3, and 4, the corner illuminable indicia 120 includes an illuminating portion 125, an outer portion 121, at least one connecting portion 123, at least one bracket 124, and an outer side 126. The illuminating portion 125 may include a plurality of lights, light bulbs, light-emitting diodes, or equivalent that illuminate in numerous different sequences. The outer portion 121 covers the illuminating portion 125. The outer portion 121 provides the illuminating portion 125 protection from different impacts that may occur during game play, such as repeated impacts from the projectile 160. The outer portion 121 is made from a rigid and partially transparent material, which the transparency allows the game's players to view the illuminating sequences easily.

In some examples, the corner illuminable indicia 120 includes at least one connecting portion 123, which is configured to connect to an end wall 102 or a side wall 104. The at least one bracket 124 secures the corner illuminable indicia 120 to the end wall 102 or the side wall 104.

Figure 5:
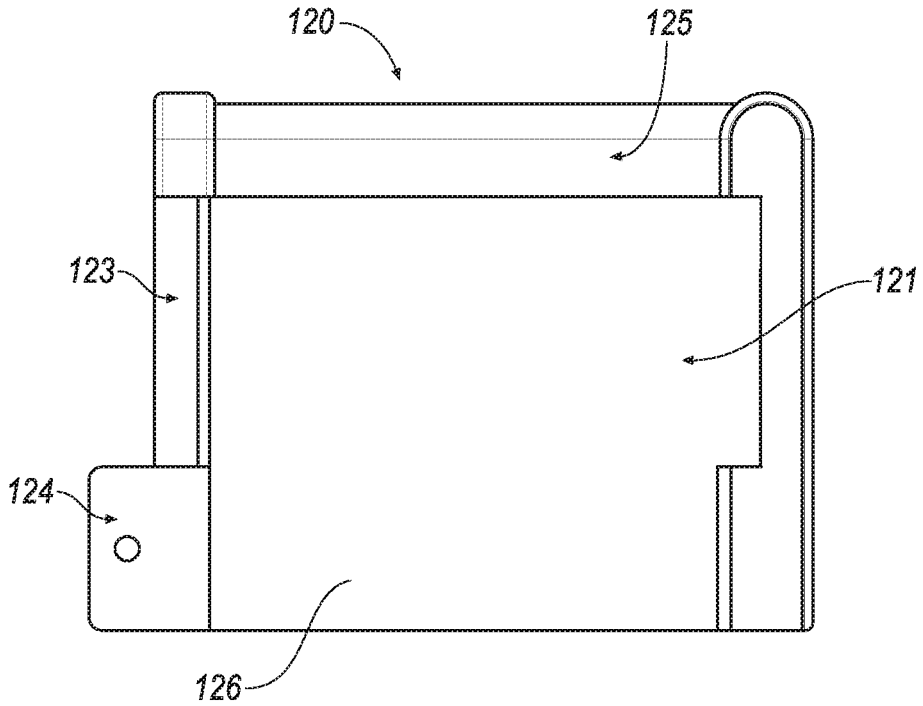
FIG. 5 is another plan view of an example corner illuminable indicia.
Figure 6:
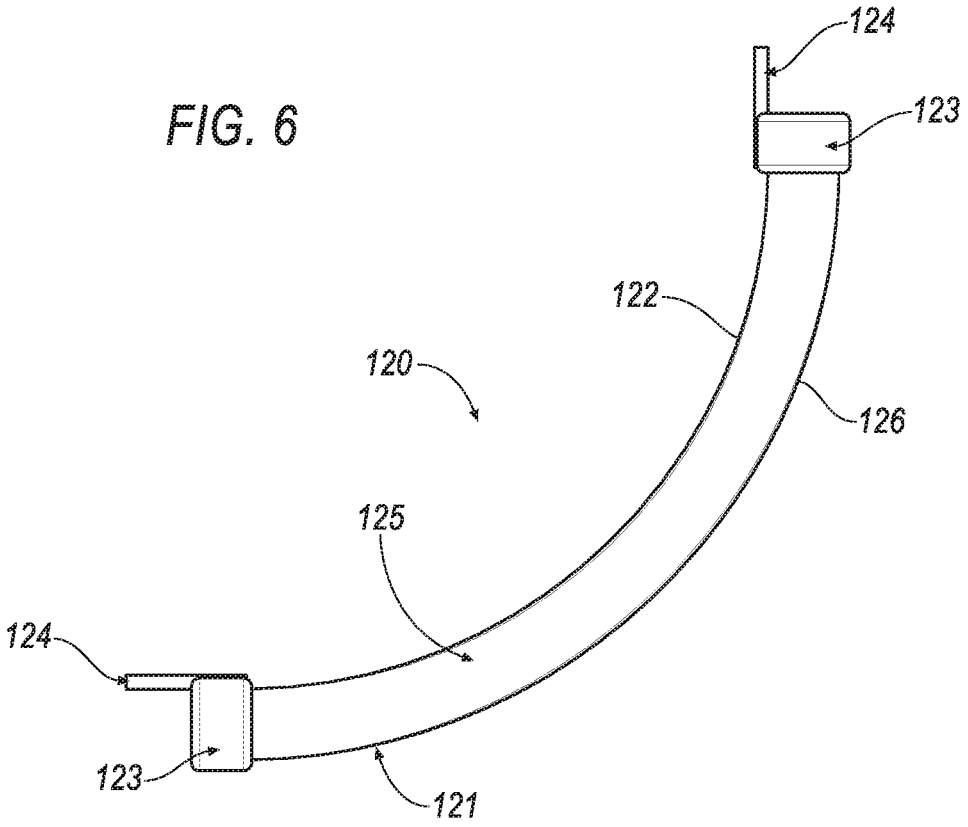
FIG. 6 is a top view of an example corner illuminable indicia.

Referring to FIGS. 5 and 6, the corner illuminable indicia 120 includes an illuminating portion 125, at least one connecting portion 123, at least one bracket 124, an outer portion 121, and an inner side 122.

Figure 7:
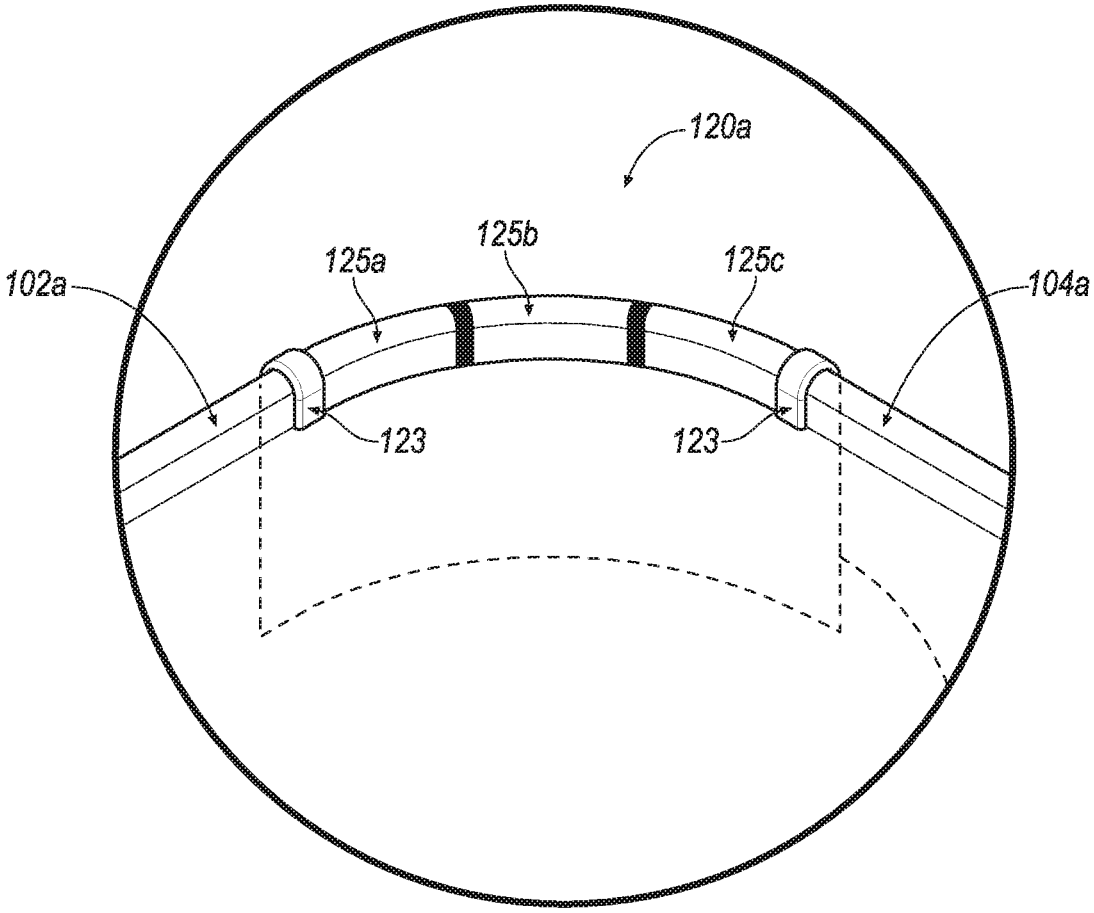
FIG. 7 is a close-up view of an example corner illuminable indicia defined in FIG. 1.

Now referring to FIG. 7, the first corner illuminable indicia 120*a* is shown, as defined in FIG. 1. The first corner illuminable indicia 120*a* is shown in an installed position, where its connection to the first end wall 102*a* and the first side wall 104*a* is flush. In some implementations, the illuminating portion 125, of the corner illuminable indicia 120, consists of a first illuminating portion 125*a*, a second illuminating portion 125*b*, and a third illuminating portion 125*c*. The first illuminating portion 125*a*, the second illuminating portion 125*b*, and the third illuminating portion 125*c* illuminate in different sequences to indicate a status of a game event.

Figure 8A:
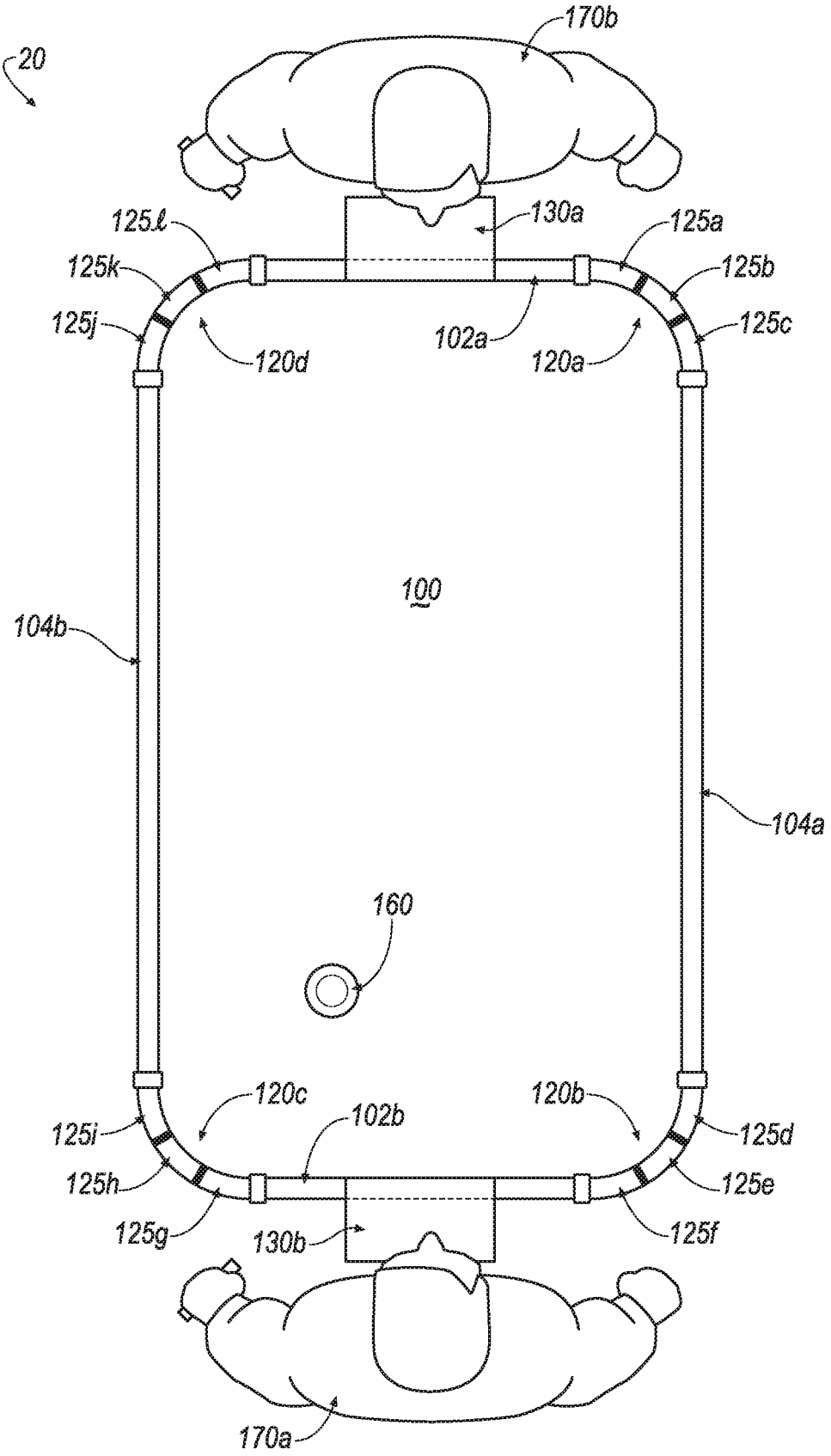
FIG. 8A is a top view of an example game scoring and tracking system with four example corner illuminable indicia in an unilluminated state.

Referring to FIG. 8A, in some implementations, the game scoring and tracking system 20 includes a first corner illuminable indicia 120*a*, a second corner illuminable indicia 120*b*, a third corner illuminable indicia 120*c*, and a fourth corner illuminable indicia 120*d*. The corner illuminable indicia 120*a-d* are shown in an unilluminated state. In some examples, the first corner illuminable indicia 120*a* comprises a first illuminating portion 125*a*, a second illuminating portion 125*b*, and a third illuminating portion 125*c*. The second corner illuminable indicia 120*b* comprises a first illuminating portion 125*d*, a second illuminating portion 125*e*, and a third illuminating portion 125*f*. The third corner illuminable indicia 120*c* comprises a first illuminating portion 125*g*, a second illuminating portion 125*h*, and a third illuminating portion 125*i*. The fourth corner illuminable indicia 120*d* comprises a first illuminating portion 125*j*, a second illuminating portion 125*k*, and a third illuminating portion 125*l*. In some examples, the corner illuminable indicia 120*a-d* illuminate in numerous sequences to indicate the status of a game event.

Figure 8B:
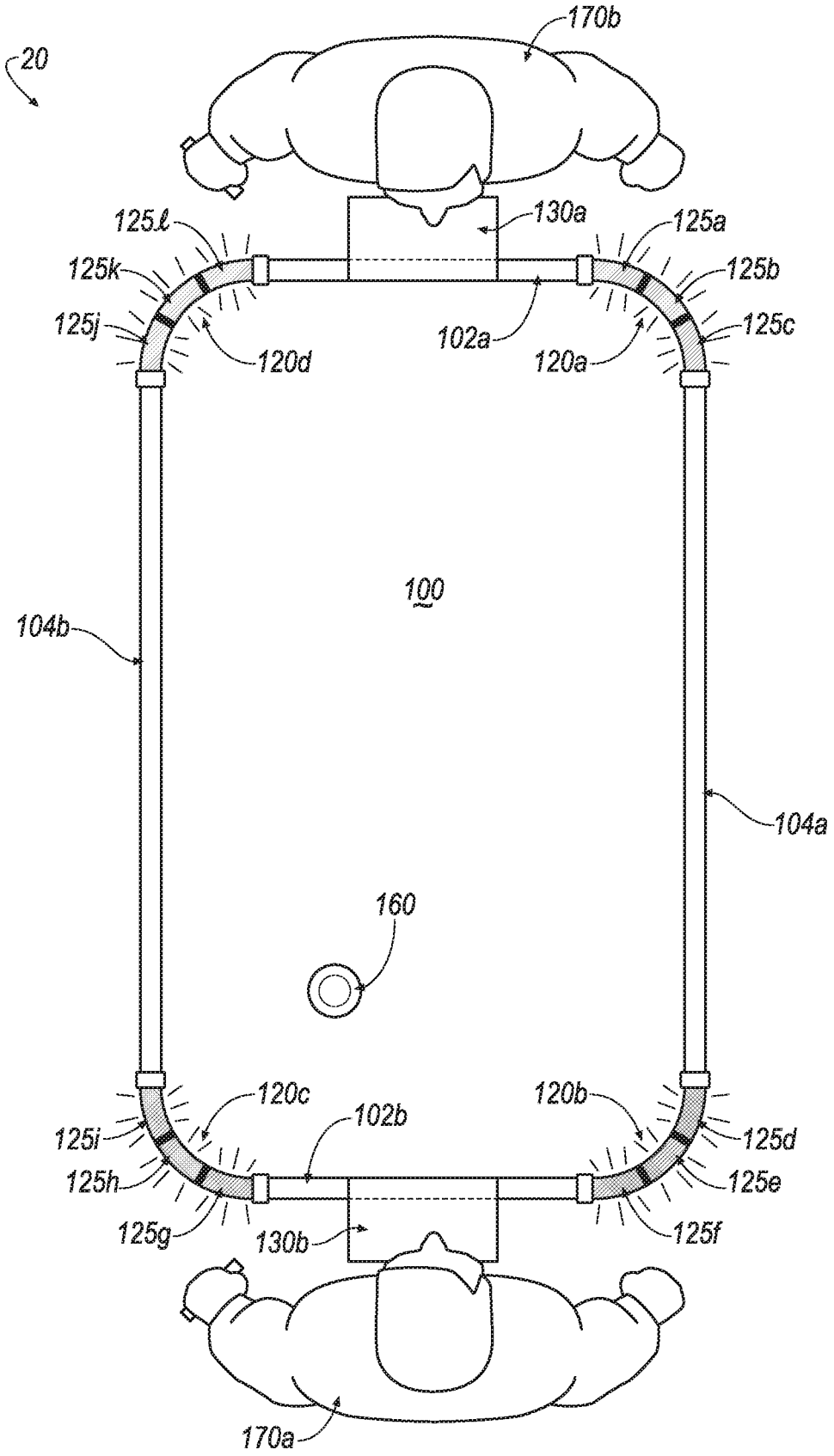
FIG. 8B is a top view of an example game scoring and tracking system with four example corner illuminable indicia in an illuminated state.

Now referring to FIG. 8B, the first corner illuminable indicia 120*a*, the second corner illuminable indicia 120*b*, the third corner illuminable indicia 120*c*, and the fourth corner illuminable indicia 120*d* are shown in an illuminated state.

Figure 8C:
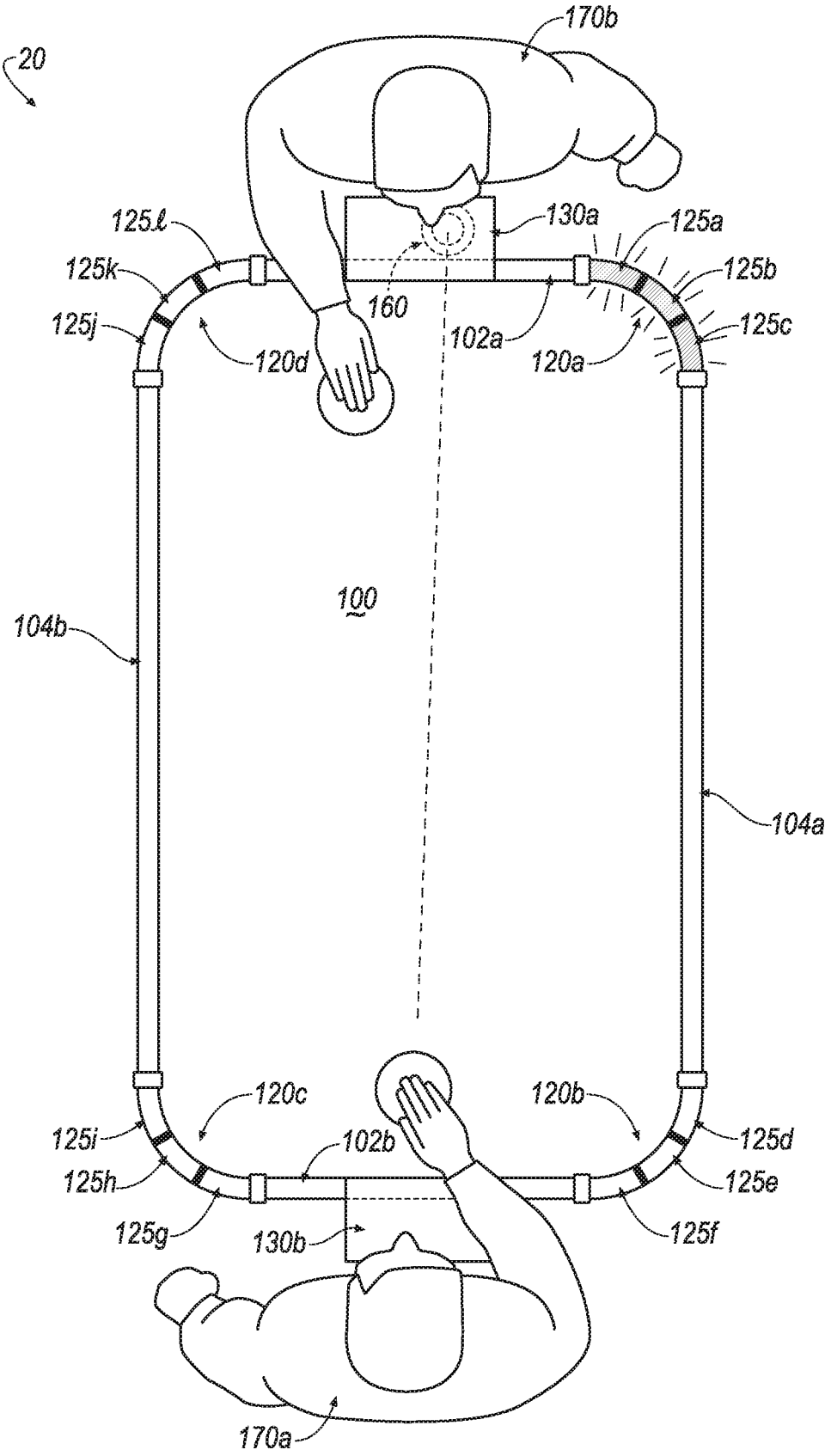
FIG. 8C is a top view of a table game incorporating an example game scoring and tracking system with an example corner illuminable indicia in an illuminated state indicating a goal has been scored.

Referring to FIG. 8C, a first player 170*a* has scored a goal. As in some examples, upon the occurrence of the first at least one sensor 140*a* detecting the projectile 160 entering the first goal 130*a*, the first corner illuminable indicia 120*a*, the fourth corner illuminable indicia 120*d*, and the at least one speaker will operate in a first scoring mode. As shown, the first corner illuminable indicia 120*a* has begun to illuminate in a sequence to indicate the first player 170*a* has scored a goal, and the at least one speaker 112 will play a sound to indicate that the first player 170*a* has scored a goal.

Figure 9A:
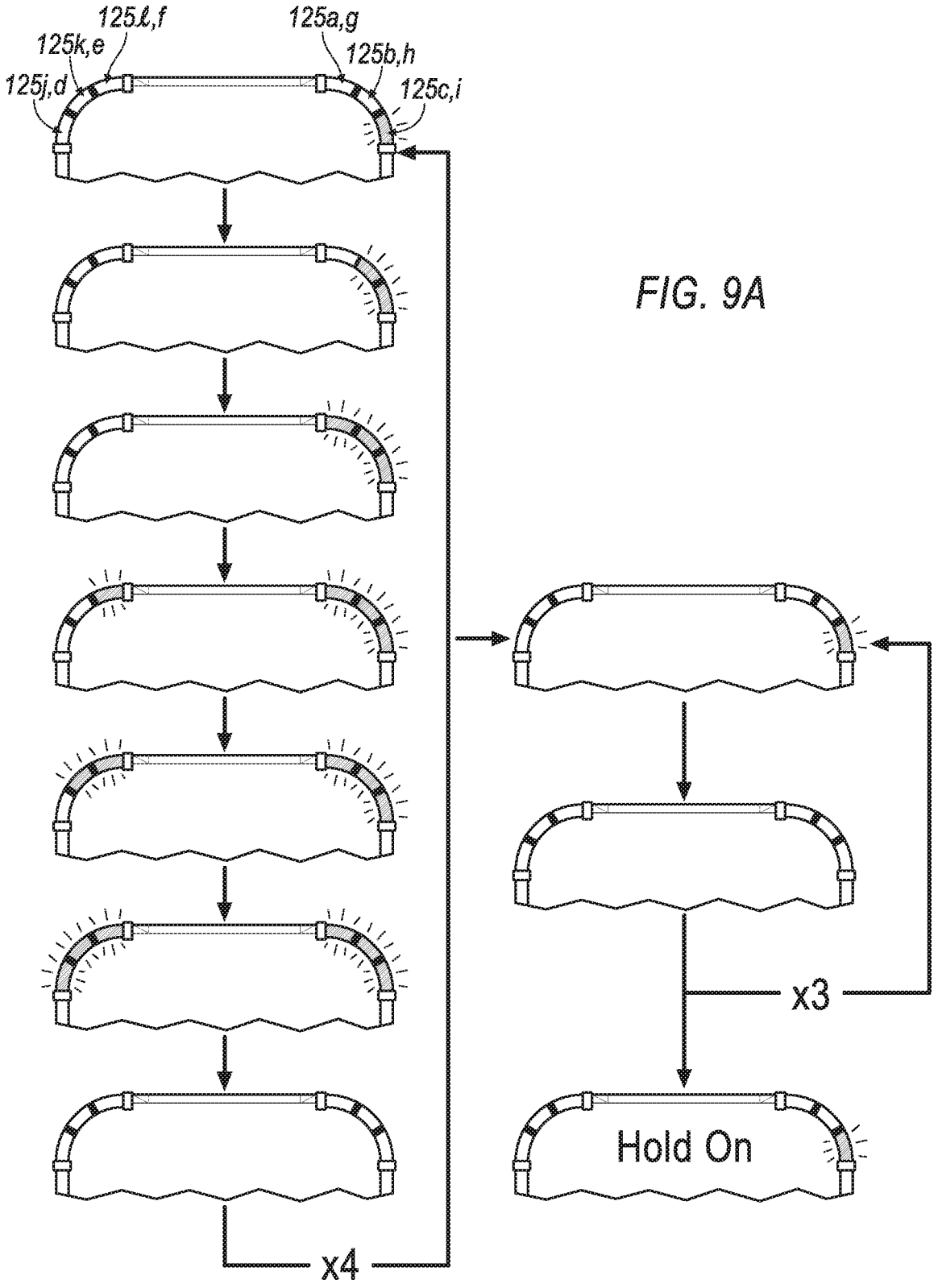
FIG. 9A is a partial top view of an example illuminating sequence of a first and second example corner illuminable indicia indicating a first goal has been scored.

Now referring to FIG. 9A, shown is an example illuminating sequence indicating a player 170 has scored a first goal. Upon the occurrence of the first at least one sensor 140*a* detecting the projectile 160 entering the first goal 130*a*, the first corner illuminable indicia 120*a*, the fourth corner illuminable indicia 120*d*, and the at least one speaker 112 will operate in a first scoring mode. The first corner illuminable indicia 120*a* and the fourth corner illuminable indicia 120*d* will illuminate in this example sequence, and the at least one speaker 112 will output a sound if the first player 170*a* has scored the goal.

In this example sequence, first, the illuminating portion 125*c* will illuminate, it will stay illuminable for approximately 0.1 s to 2 s, and then it will turn off. Next, the illuminating portion 125*b* will illuminate, it will stay illuminated for approximately 0.1 s to 2 s, and then it will turn off. Ensuing, the illuminating portion 125*a* will illuminate, it will stay illuminated for approximately 0.1 s to 2 s, and then it will turn off. Subsequently, the illuminating portion 125*l* will illuminate, it will stay illuminated for approximately 0.1 s to 2 s, and then it will turn off. Followed by, the illuminating portion 125*k* will illuminate, it will stay illuminated for approximately 0.1 s to 2 s, and then it will turn off. Lastly, the illuminating portion 125*j* will illuminate, it will stay illuminated for approximately 0.1 s to 2 s, and then it will turn off. This pattern will repeat four times.

Immediately following, the illuminating sequence indicating the first player's 170*a* score will begin. Since the first player 170*a* scored its first goal, the illuminating portion 125*c* will then illuminate, it will stay illuminable for approximately 0.1 s to 2 s, and then it will turn off. This pattern will repeat itself three times. Upon competition, the illuminating portion 125*c* will stay illuminable, indicating the first player's 170*a* score is one.

Upon the occurrence of the second at least one sensor 140*b* detecting the projectile 160 entering the second goal 130*b*, the second corner illuminable indicia 120*b*, the third corner illuminable indicia 120*c*, and the at least one speaker 112 will operate in a second scoring mode. The second corner illuminable indicia 120*b* and the third corner illuminable indicia 120*c* will illuminate in this example sequence and the at least one speaker 112 will output a sound if the second player 170*b* has scored the goal.

In this example sequence, first, the illuminating portion 125*i* will illuminate, it will stay illuminated for approximately 0.1 s to 2 s, and then it will turn off. Next, the illuminating portion 125*h* will illuminate, it will stay illuminated for approximately 0.1 s to 2 s, and then it will turn off. Ensuing, the illuminating portion 125*g* will illuminate, it will stay illuminated for approximately 0.1 s to 2 s, and then it will turn off. Subsequently, the illuminating portion 125*f* will illuminate, it will stay illuminated for approximately 0.1 s to 2 s, and then it will turn off. Followed by, the illuminating portion 125*e* will illuminate, it will stay illuminated for approximately 0.1 s to 2 s, and then it will turn off. Lastly, the illuminating portion 125*d* will illuminate, it will stay illuminated for approximately 0.1 s to 2 s, and then it will turn off. This pattern will repeat four times.

Immediately following, the illuminating sequence indicating the second player's 170*b* score will begin. Since the second player 170*b* scored its first goal, the illuminating portion 125*i* will then illuminate, it will stay illuminated for approximately 0.1 s to 2 s, and then it will turn off. This pattern will repeat itself three times. Upon competition, the illuminating portion 125*i* will stay illuminated, indicating the second player's 170*b* score is one.

Figure 9B:
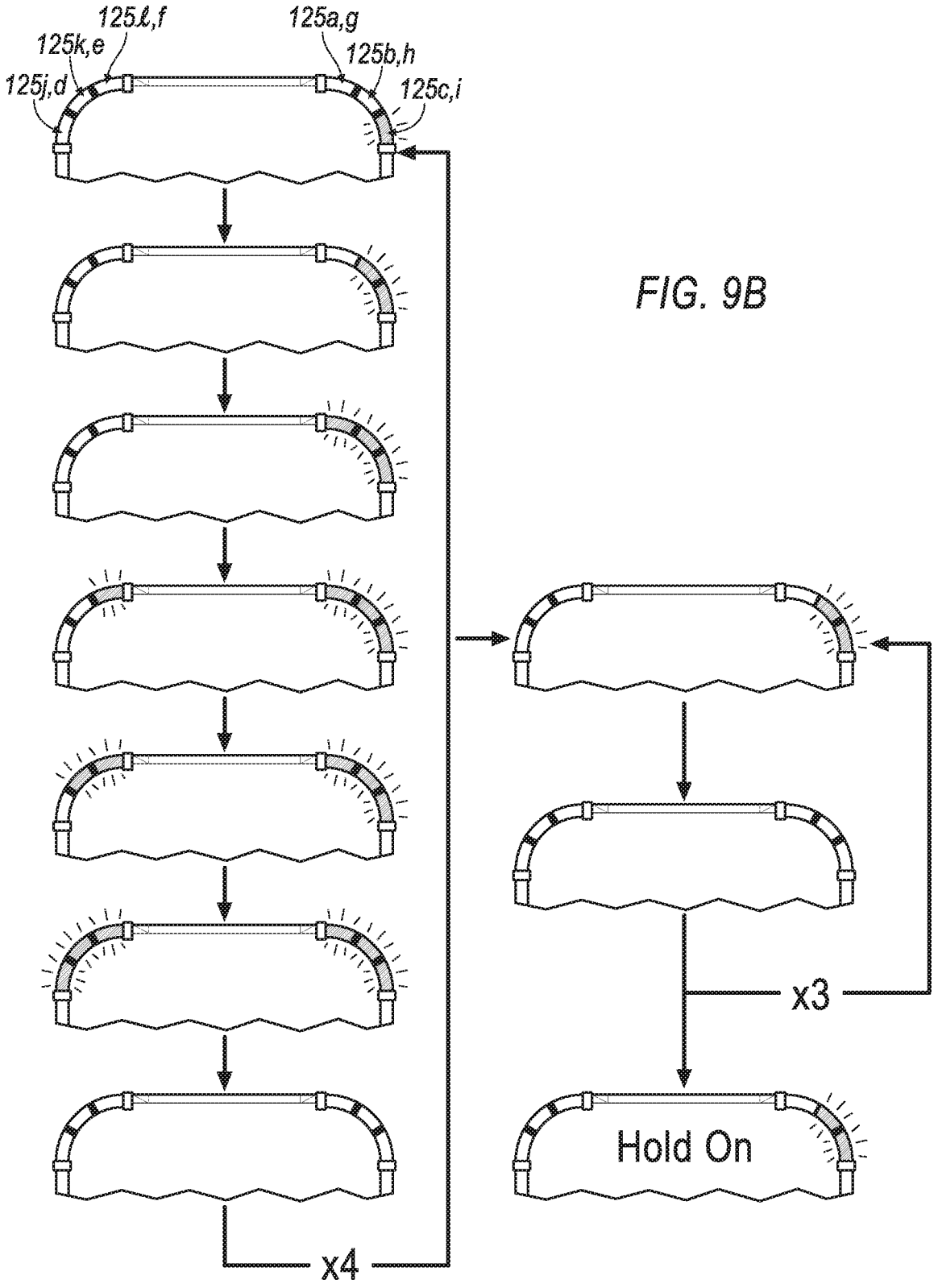
FIG. 9B is a partial top view of an example illuminating sequence of a first and second example corner illuminable indicia indicating a second goal has been scored.

Referring to FIG. 9B, shown is an example illuminating sequence indicating a player 170 has scored a second goal. Upon the occurrence of the first at least one sensor 140*a* detecting the projectile 160 entering the first goal 130*a*, the first corner illuminable indicia 120*a*, the fourth corner illuminable indicia 120*d*, and the at least one speaker 112 will operate in a first scoring mode. The first corner illuminable indicia 120*a* and the fourth corner illuminable indicia 120*d* will illuminate in this example sequence if the first player 170*a* has scored the goal. Additionally, the at least one speaker 112 will output a sound to indicate a goal has been scored. The sequence and the sound will begin after the first at least one sensor 140*a* has detected the projectile 160 entering the first goal 130*a*.

In this example sequence, first, the illuminating portion 125*c* will illuminate, it will stay illuminated for approximately 0.1 s to 2 s, and then it will turn off. Next, the illuminating portion 125*b* will illuminate, it will stay illuminated for approximately 0.1 s to 2 s, and then it will turn off. Ensuing, the illuminating portion 125*a* will illuminate, it will stay illuminated for approximately 0.1 s to 2 s, and then it will turn off. Subsequently, the illuminating portion 125*l* will illuminate, it will stay illuminated for approximately 0.1 s to 2 s, and then it will turn off. Followed by, the illuminating portion 125*k* will illuminate, it will stay illuminated for approximately 0.1 s to 2 s, and then it will turn off. Lastly, the illuminating portion 125*j* will illuminate, it will stay illuminated for approximately 0.1 s to 2 s, and then it will turn off. This pattern will repeat four times.

Immediately following, the illuminating sequence indicating the first player's 170*a* score will begin. Since the first player 170*a* scored its second goal, the illuminating portion 125*c* and the illuminating portion 125*b* will then illuminate, they will stay illuminated for approximately 0.1 s to 2 s, and then they will turn off. This pattern will repeat itself three times. Upon competition, the illuminating portion 125*c* and the illuminating portion 125*b* will stay illuminated, indicating the first player's 170*a* score is two.

Furthermore, if the first player 170*a* scores its third goal, then for the illuminating sequence indicating the first player's 170*a* score, the illuminating portion 125*c*, the illuminating portion 125*b*, and the illuminating portion 125*a* would illuminate, they would stay illuminated for approximately 0.1 s to 2 s, and then they would turn off. This pattern will repeat itself three times. Upon competition, the illuminating portion 125*c*, the illuminating portion 125*b*, and the illuminating portion 125*a* would stay illuminated, indicating the first player's 170*a* score is three.

Moreover, if the first player 170*a* scores its fourth goal, then for the illuminating sequence indicating the first player's 170*a* score, the illuminating portion 125*c*, the illuminating portion 125*b*, the illuminating portion 125*a*, and the illuminating portion 125*l* would then illuminate, they would stay illuminated for approximately 0.1 s to 2 s, and they would turn off. This pattern will repeat itself three times. Upon competition, the illuminating portion 125*c*, the illuminating portion 125*b*, the illuminating portion 125*a*, and the illuminating portion 125*l* would stay illuminated, indicating the first player's 170*a* score is four.

Likewise, if the first player 170*a* scores its fifth goal, then for the illuminating sequence indicating the first player's 170*a* score, the illuminating portion 125*c*, the illuminating portion 125*b*, the illuminating portion 125*a*, the illuminating portion 125*l*, and the illuminating portion 125*k* would illuminate, they would stay illuminated for approximately 0.1 s to 2 s, and then they would turn off. This pattern will repeat itself three times. Upon competition, the illuminating portion 125*c*, the illuminating portion 125*b*, the illuminating portion 125*a*, the illuminating portion 125*l*, and the illuminating portion 125*k* would stay illuminated, indicating the first player's 170*a* score is five.

Upon the occurrence of the second at least one sensor 140*b* detecting the projectile 160 entering the second goal 130*b*, the second corner illuminable indicia 120*b*, the third corner illuminable indicia 120*c*, and the at least one speaker 112 will operate in a second scoring mode. The second corner illuminable indicia 120*b* and the third corner illuminable indicia 120*d* will illuminate in this example sequence if the second player 170*b* has scored the goal. Additionally, the at least one speaker 112 will output a sound to indicate a goal has been scored. The sequence and the sound will begin after the second at least one sensor 140*b* has detected the projectile 160 entering the second goal 130*b*.

In this example sequence, first, the illuminating portion 125*i* will illuminate, it will stay illuminated for approximately 0.1 s to 2 s, and then it will turn off. Next, the illuminating portion 125*h* will illuminate, it will stay illuminated for approximately 0.1 s to 2 s, and then it will turn off. Ensuing, the illuminating portion 125*g* will illuminate, it will stay illuminated for approximately 0.1 s to 2 s, and then it will turn off. Subsequently, the illuminating portion 125*f* will illuminate, it will stay illuminated for approximately 0.1 s to 2 s, and then it will turn off. Followed by, the illuminating portion 125*e* will illuminate, it will stay illuminated for approximately 0.1 s to 2 s, and then it will turn off. Lastly, the illuminating portion 125*d* will illuminate, it will stay illuminated for approximately 0.1 s to 2 s, and then it will turn off. This pattern will repeat four times.

Immediately following, the illuminating sequence indicating the second player's 170*b* score will begin. Since the second player 170*b* scored its second goal, the illuminating portion 125*i* and the illuminating portion 125*h* will then illuminate, they will stay illuminated for approximately 0.1 s to 2 s, and then they will turn off. This pattern will repeat itself three times. Upon competition, the illuminating portion 125*i* and the illuminating portion 125*h* will stay illuminated, indicating the second player's 170*b* score is two.

Furthermore, if the second player 170*b* scores its third goal, then for the illuminating sequence indicating the second player's 170*b* score, the illuminating portion 125*i*, the illuminating portion 125*h*, and the illuminating portion 125*g* would illuminate, they would stay illuminated for approximately 0.1 s to 2 s, and then they would turn off. This pattern will repeat itself three times. Upon competition, the illuminating portion 125*i*, the illuminating portion 125*h*, and the illuminating portion 125*g* would stay illuminated, indicating the second player's 170*b* score is three.

Moreover, if the second player 170*b* scores its fourth goal, then for the illuminating sequence indicating the second player's 170*b* score, the illuminating portion 125*i*, the illuminating portion 125*h*, the illuminating portion 125*g*, and the illuminating portion 125*f* would illuminate, they would stay illuminated for approximately 0.1 s to 2 s, and then they would turn off. This pattern will repeat itself three times. Upon competition, the illuminating portion 125*i*, the illuminating portion 125*h*, the illuminating portion 125*g*, and the illuminating portion 125*f* would stay illuminated, indicating the second player's 170*b* score is four.

Likewise, if the second player 170*b* scores its fifth goal, then for the illuminating sequence indicating the second player's 170*b* score, the illuminating portion 125*i*, the illuminating portion 125*h*, the illuminating portion 125*g*, the illuminating portion 125*f* and the illuminating portion 125*e* would illuminate, they would stay illuminated for approximately 0.1 s to 2 s, and then they would turn off. This pattern will repeat itself three times. Upon competition, the illuminating portion 125*i*, the illuminating portion 125*h*, the illuminating portion 125*g*, the illuminating portion 125*f* and the illuminating portion 125*e* would stay illuminated, indicating the second player's 170*b* score is five.

Figure 9C:
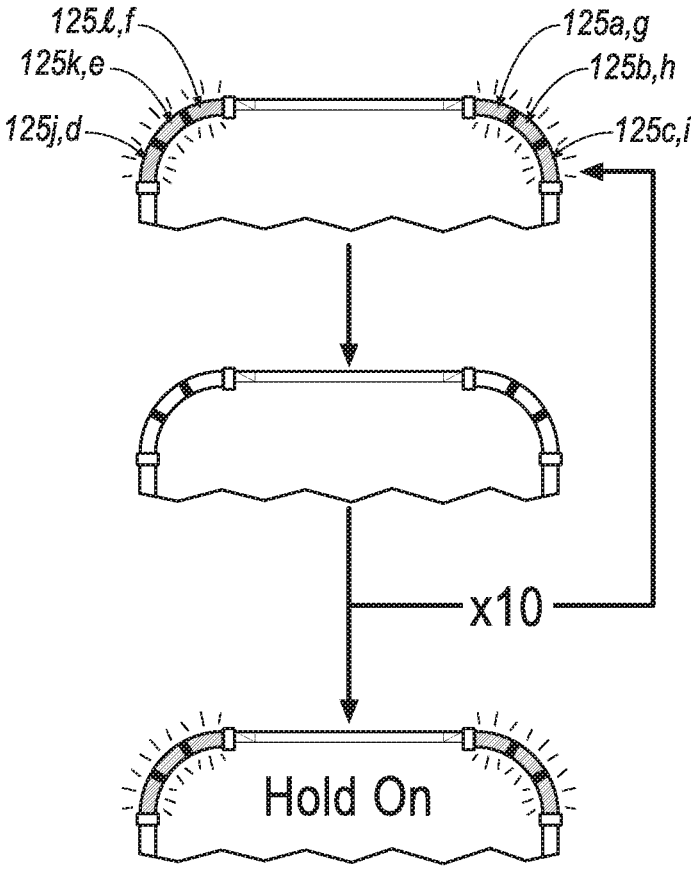
FIG. 9C is a partial top view of an example illuminating sequence of a first and second example corner illuminable indicia indicating a game winner.

Now referring to FIG. 9C. In some examples, the first player 170 to score six goals wins the game. For example, if the first player 170*a* scores its sixth goal, before the second player 170*b* scores its sixth goal, then the first player 170*a* is the game winner. Upon the first player 170*a* scoring its sixth goal, the first corner illuminable indicia 120*a*, the fourth corner illuminable indicia 120*d*, and the at least one speaker 112 will operate in a first end of game mode. The first corner illuminable indicia 120*a* and the fourth corner illuminable indicia 120*d* will illuminate in this example sequence. Additionally, the at least one speaker 112 will output a sound to indicate a sixth goal has been scored, and that the first player 170*a* is the game winner. The sequence and the sound will begin after the first at least one sensor 140*a* has detected the projectile 160 entering the first goal 130*a*.

In this example sequence, the illuminating portion 125*c*, the illuminating portion 125*b*, the illuminating portion 125*a*, the illuminating portion 125*l*, the illuminating portion 125*k*, and the illuminating portion 125*j* will illuminate, they will stay illuminated for approximately 0.1 s to 2 s, and then they will turn off. This pattern will repeat ten times.

Likewise, if the second player 170*b* scores its sixth goal, before the first player 170*a* scores its sixth goal, then the second player 170*b* is the game winner. The second corner illuminable indicia 120*b*, the third corner illuminable indicia 120*c*, and the at least one speaker 112 will operate in a second end of game mode. The second corner illuminable indicia 120*b* and the third corner illuminable indicia 120*c* will illuminate in this example sequence upon the second player 170*b* scoring its sixth goal, indicating the second player 170*b* is the game winner. Additionally, the at least one speaker 112 will output a sound to indicate a sixth goal has been scored, and that the second player 170*b* is the game winner. The sequence and the sound will begin after the second at least one sensor 140*b* has detected the projectile 160 entering the second goal 130*b*.

In this example sequence, the illuminating portion 125*i*, the illuminating portion 125*h*, the illuminating portion 125*g*, the illuminating portion 125*f* the illuminating portion 125*e*, and the illuminating portion 125*d* will illuminate, they will stay illuminated for approximately 0.1 s to 2 s, and then they will turn off. This pattern will repeat ten times.

Figure 9D:
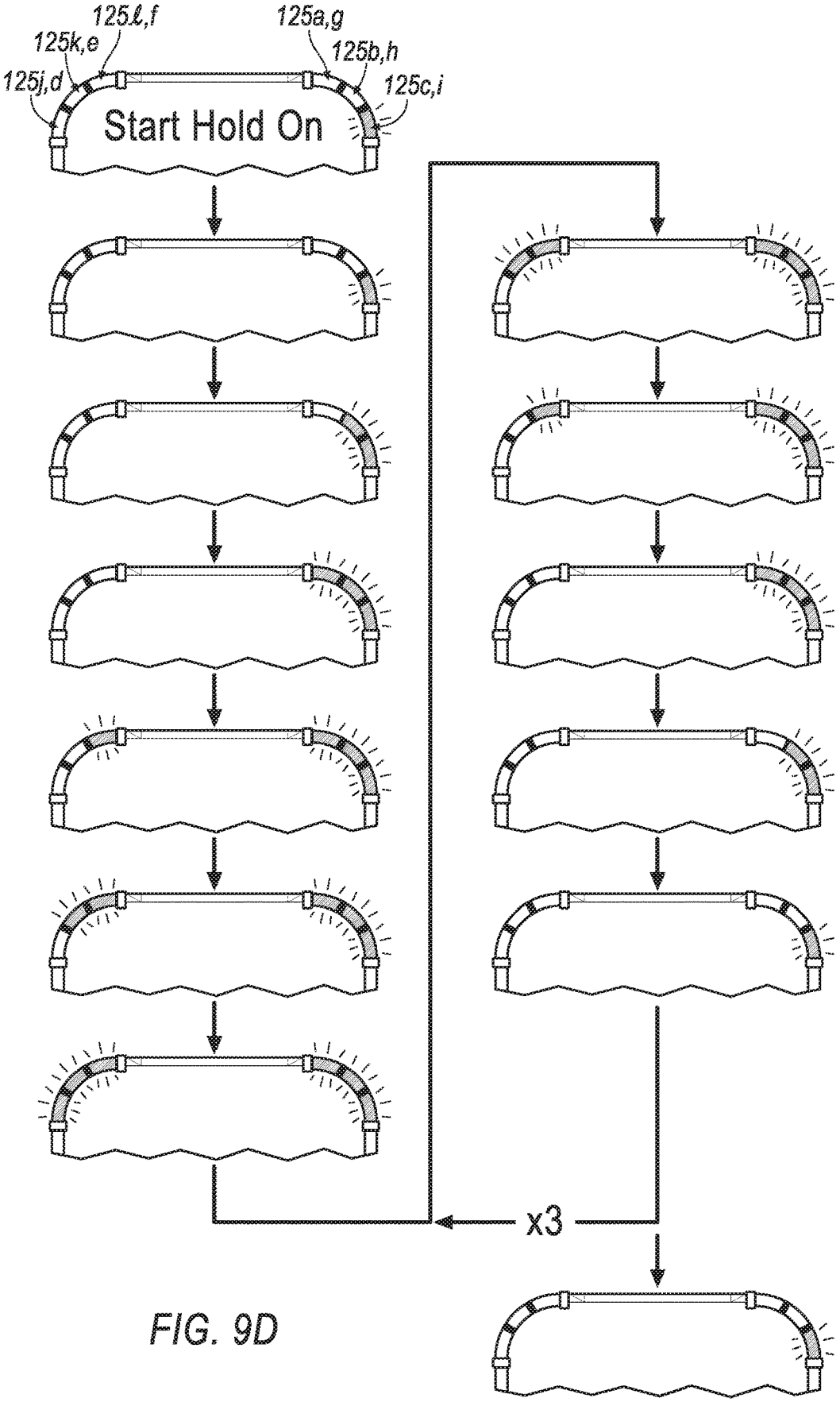
FIG. 9D is a partial top view of an example illuminating sequence of a first and second example corner illuminable indicia indicating a goal has not been scored for a predetermined time.

Now referring to FIG. 9D, shown is an example illuminating sequence indicating that no goal has been scored for a predetermined period of time. In some implementations, if both the first player 170*a* and the second player 170*b* have not scored a goal for approximately 3 s to 5 s, then the corner illuminating indicia 120*a-d* and the at least one speaker 112 will operate in a rah-rah mode. The corner illuminating indicia 120*a-d* will illuminate in this example sequence and the at least one speaker 112 will output a sound.

The example shows the illuminating portions 125 will illuminate and then will remain illuminated in the following order: 125*c*, 125*b*, 125*a*, 125*l*, 125*k*, and 125*j*. Next, the illumination portions 125 will turn off in the following order: 125*j*, 125*k*, 125*l*, 125*a*, 125*b*, and 125*c*. This pattern will repeat three times, and then the first player's 170*a* current score will remain illuminated.

Concurrently, the illuminating portions 125 will illuminate and will then remain illuminated in the following order: 125*i*, 125*h*, 125*g*, 125*f*, 125*e*, and 125*d*. Next, the illumination portions 125 will turn off in the following order: 125*d*, 125*e*, 125*f*, 125*g*, 125*h*, and 125*i*. This pattern will repeat three times, and then the second player's 170*b* current score will remain illuminated.

A number of implementations have been described. Nevertheless, it will be understood that various modifications may be made without departing from the spirit and scope of the disclosure. Accordingly, other implementations are within the scope of the following claims.

What is claimed is:

1. A game table, comprising:

a playing surface, wherein a projectile is configured for use on the playing surface;

a first and a second end wall extending generally perpendicular from the playing surface, the first end wall spaced apart from the second end wall;

a first and a second side wall extending between the first and the second end wall, the first side wall spaced apart from the second side wall;

a first goal located along the first end wall and a second goal located along the second end wall;

a first corner illuminable indicia configured to connect either the first end wall to the first side wall or the first end wall to the second side wall; and a second corner illuminable indicia configured to connect either the second end wall to the first side wall or the second end wall to the second side wall, wherein the first and the second corner illuminable indicia are configured to illuminate upon the occurrence of a game event.

2. The game table of claim 1, wherein the first and the second corner illuminable indicia include illuminating portions that have a plurality of light-emitting diodes, the illuminating portions are configured to illuminate in different sequences to indicate a status of a game event.

3. The game table of claim 2, wherein the illuminating portions of the first and the second corner illuminable indicia are configured to illuminate in a first sequence upon the occurrence of a start of a new game defining a power-up mode.

4. The game table of claim 3, wherein the illuminating portion of the first corner illuminable indicia is configured to illuminate in a second sequence upon the occurrence of the projectile entering the first goal defining a first scoring mode.

5. The game table of claim 4, wherein the illuminating portion of the second corner illuminable indicia is configured to illuminate in a third sequence upon the occurrence of the projectile entering the second goal defining a second scoring mode.

6. The game table of claim 5, wherein the illuminating portion of the first corner illuminable indicia is configured to display a first score, the first score is representative of the number of times the projectile enters the first goal.

7. The game table of claim 6, wherein the illuminating portion of the second corner illuminable indicia is configured to display a second score, the second score is representative of the number of times the projectile enters the second goal.

8. The game table of claim 7, wherein the illuminating portions of the first and the second corner illuminable indicia are configured to illuminate in a fourth sequence upon the occurrence of the projectile not entering the first goal nor the second goal for a predetermined time defining a rah-rah mode.

9. The game table of claim 8, wherein the illuminating portion of the first corner illuminable indicia is configured to illuminate in a fifth sequence to indicate a game winner upon the first score reaching a predetermined threshold defining a first end of game mode.

10. The game table of claim 9, wherein the illuminating portion of the second corner illuminable indicia is configured to illuminate in a sixth sequence to indicate a game winner upon the second score reaching a predetermined threshold defining a second end of game mode.

11. A game table, comprising:

a playing surface, wherein a projectile is configured for use on the playing surface;

a first and a second end wall extending generally perpendicular from the playing surface, the first end wall spaced apart from the second end wall;

a first and a second side wall extending between the first and the second end wall, the first side wall spaced apart from the second side wall;

a first goal located along the first end wall and a second goal located along the second end wall;

a first corner illuminable indicia configured to connect the first end wall to the first side wall;

a second corner illuminable indicia configured to connect the first end wall to the second side wall;

a third corner illuminable indicia configured to connect the second end wall to the second side wall; and a fourth corner illuminable indicia configured to connect the second end wall to the first side wall, wherein the first, the second, the third and the fourth corner illuminable indicia are configured to illuminate upon the occurrence of a game event.

12. The game table of claim 11, wherein the first, the second, the third and the fourth corner illuminable indicia include illuminating portions that have a plurality of light-emitting diodes, the illuminating portions are configured to illuminate in different sequences to indicate a status of a game event.

13. The game table of claim 12, wherein the illuminating portions of the first, the second, the third and the fourth corner illuminable indicia are configured to illuminate in a first sequence upon the occurrence of a start of a new game defining a power-up mode.

14. The game table of claim 13, wherein the illuminating portions of the first and the second corner illuminable indicia are configured to illuminate in a second sequence upon the occurrence of the projectile entering the first goal defining a first scoring mode.

15. The game table of claim 14, wherein the illuminating portions of the third and the fourth corner illuminable indicia are configured to illuminate in a third sequence upon the occurrence of the projectile entering the second goal defining a second scoring mode.

16. The game table of claim 15, wherein the illuminating portions of the first and the second corner illuminable indicia are configured to display a first score, the first score is representative of the number of times the projectile enters the first goal.

17. The game table of claim 16, wherein the illuminating portions of the third and the fourth corner illuminable indicia are configured to display a second score, the second score is representative of the number of times the projectile enters the second goal.

18. The game table of claim 17, wherein the illuminating portions of the first, the second, the third and the fourth corner illuminable indicia are configured to illuminate in a fourth sequence upon the occurrence of the projectile not entering the first goal nor the second goal for a predetermined time defining a rah-rah mode.

19. The game table of claim 18, wherein the illuminating portions of the first and the second corner illuminable indicia are configured to illuminate in a fifth sequence to indicate a game winner upon the first score reaching a predetermined threshold defining a first end of game mode.

20. The game table of claim 19, wherein the illuminating portions of the third and the fourth corner illuminable indicia are configured to illuminate in a sixth sequence to indicate a game winner upon the second score reaching a predetermined threshold defining a second end of game mode.

* * * * *